United States Patent [19]

Kim

[11] 4,084,085

[45] Apr. 11, 1978

[54] PURSE WITH LIGHT MIRROR

[76] Inventor: Sunyong P. Kim, 3805 S. Norton Ave., Los Angeles, Calif. 90008

[21] Appl. No.: 745,820

[22] Filed: Nov. 29, 1976

[51] Int. Cl.[2] ..... F21V 33/00

[52] U.S. Cl. ..... 362/135; 150/34; 362/156

[58] Field of Search ..... 240/4.2, 6.45 P; 150/28 R, 34, 35

[56] References Cited

U.S. PATENT DOCUMENTS

| | | | |
|---|---|---|---|
| 1,592,457 | 7/1926 | Greenberg | 150/34 |
| 1,622,306 | 3/1927 | Borfuss | 150/34 |
| 1,719,040 | 7/1929 | Barol | 150/34 |
| 1,785,609 | 12/1930 | Baumann | 150/34 |
| 2,003,130 | 5/1935 | Benjafield | 240/6.45 P |
| 2,055,569 | 9/1936 | Zolotow | 150/34 |
| 2,285,454 | 6/1942 | Moss | 240/6.45 P |
| 3,381,119 | 4/1968 | Brickman | 240/4.2 |
| 3,526,763 | 9/1970 | Dorfman | 240/4.2 |
| 3,926,470 | 12/1975 | Marcus | 240/4.2 |

FOREIGN PATENT DOCUMENTS

| | | | |
|---|---|---|---|
| 696,130 | 12/1930 | France | 150/34 |
| 949,194 | 10/1949 | France | 150/34 |
| 589,490 | 5/1925 | France | 150/34 |
| 388,953 | 3/1933 | United Kingdom | 150/34 |

*Primary Examiner*—Ro E. Hart
*Attorney, Agent, or Firm*—John T. Matlago

[57] ABSTRACT

A woman's handbag is adapted to have a mirror with side illumination means attached to the undersurface of an outer flap which is an integral part of the handbag.

4 Claims, 5 Drawing Figures

16
15
13
22
55
20
16
15
23
17
19
12
10

45
21
17
31
13
52
30
3
16
15
45
44
23
31
53
25
3
49
19
16
15
10
12

20
21
21b
24
21a
30
35
31
45
27
37
28
38
33
54
36
41
44
49
51
40
21a
21b
21
24

21b
21a
24
21
20
22
30
45
31
27
28
47

27
28
45
45
31
52
20
30
53
31
35
25
35
41
40
41
33
36
43
44
13
21

PURSE WITH LIGHT MIRROR

This invention relates to a woman's purse or handbag and more particularly to such a handbag provided with an illuminated mirror.

Women frequently find themselves in a position where they would like to look their best and are therefore interested in viewing their face and/or applying makeup thereto. Thus, although a woman usually carries a handbag with her which includes a mirror and various forms of makeup for such purposes, she frequently finds herself in a place where the ambient light is not sufficient to enable her to view herself in the mirror.

Accordingly, the object of the present invention is to adapt a woman's handbag to conveniently hold a mirror together with illuminating means therefor.

Another object of the present invention is to provide for fixedly attaching a mirror with illuminating means on the inside of the flap of a woman's handbag.

These and other objects and advantages of the invention will be readily apparent from the ensuing description of the drawings in which.

Figure 1:
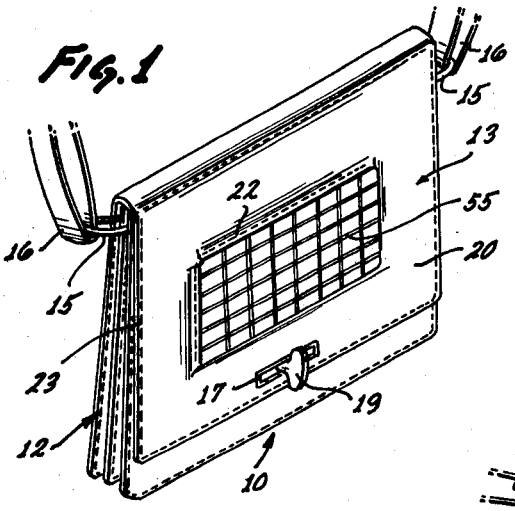
FIG. 1 is an overall perspective view of the handbag embodying the present invention.
Figure 2:
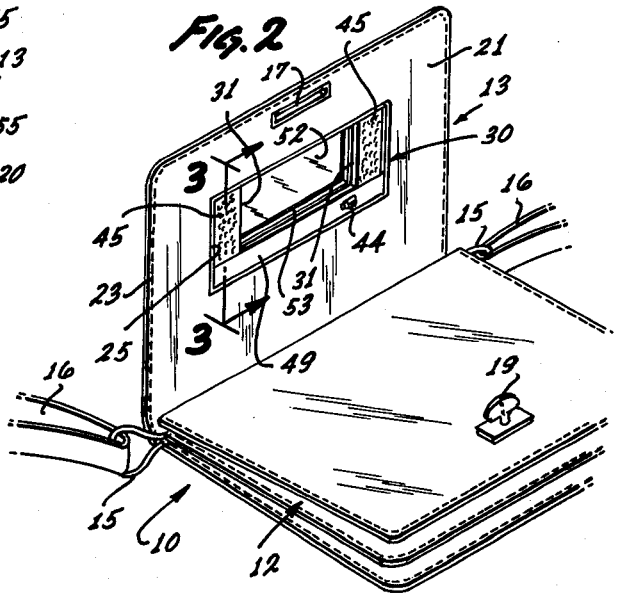
FIG. 2 is a perspective view of the handbag of FIG. 1 with its flap opened up to reveal the mirror and illuminating means attached within an opening in the under surface thereof.

Referring to the drawings, a woman's purse or handbag 10 embodying the present invention is shown in FIGS. 1 and 2. The handbag 10, which is preferably rectangularly shaped, comprises a conventional pocket 12 provided with an outer flap 13. The flap 13 is preferably an integral extension of the back wall of the pocket 12 and folds downwardly to substantially cover the front wall thereof. The pocket of the handbag 10 has metal rings 15 on the opposite top corners thereof for attachment to the looped ends of a strap 16 in a conventional manner. To secure the outer flap 13, as when the handbag is being carried, an opening 17 is provided at the bottom portion thereof which fits over a rotating latch 19 attached on the bottom portion of the front wall of the pocket 12.

Figure 4:
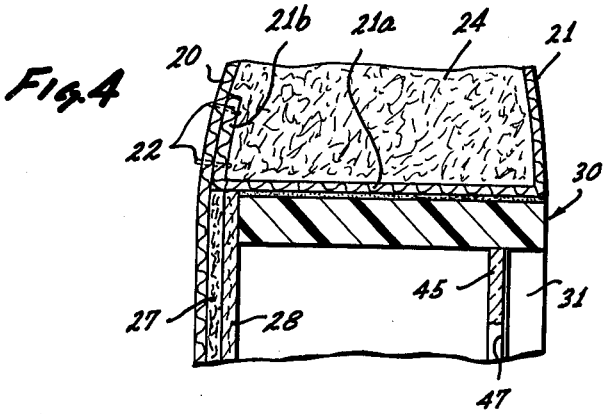
FIG. 4 is an enlarged view of the upper end of the section shown in FIG. 1.
Figure 5:
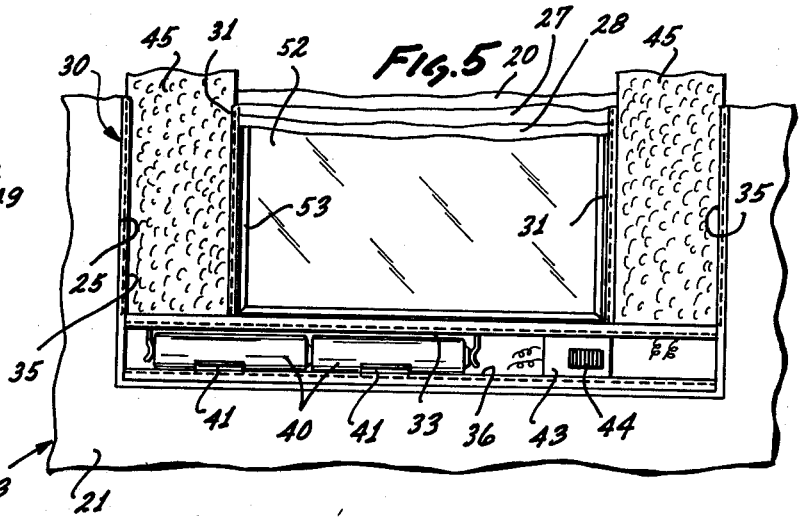
FIG. 5 is a fragmentary enlarged view of the flap looking down on the mirror and the illuminating means secured thereon.

The flap 13 on the handbag is constructed of an outer sheet 20 and an inner sheet 21 of leather or similar material. The peripheries of these sheets are secured together by stitches 23. The inner sheet 21 has a rectangular cutout in the central portion thereof. The edge portions 21a of the four sides of the rectangular cutout are folded back so as to extend normal to the plane of the flap 13 and the terminating edges 21b thereof are then folded back again and secured by stitches 22 (FIG. 4) to the outer sheet 20 of the flap 13. The folded back edge portions 21a of the four sides of the cutout thus form a rectangularly shaped well 25 on the underside of the flap 13. A padding material 24 is inserted in the generally triangular spacing formed between the peripheral portions of the inner and outer sheets surrounding the rectangular well 25. This padding material in addition to giving a body to the flap 13 serves to support the walls of the well 25 as formed by the folded back edge portions 21a of the inner sheet 21. In the bottom of the opening of the well 25, a thin layer of padding material 27 is placed against the outer sheet 20 of the flap 13 and a paper sheet 28 is glued over the sheet of padding material.

Positioned within the well 25 is a rectangular framework 30 whose outer walls contact the walls of the well and are glued in position. The framework 30, the exposed ends of which are flush with the surface of the inner sheet 21, includes transverse partitions 31 spaced inwardly from each of the transverse sidewalls of the framework 30 to form a pair of side light compartments 35 and includes an elongated partition 33 spaced from the lower longitudinal wall of the framework 30 (FIG. 2) to form a battery compartment 36. The framework 30 may be formed of plastic material.

An elongated light bulb 37 is inserted in a socket 38 fixed on the lower end wall of each of the side light compartments 35. A pair of batteries 40 are housed in the battery compartment 36 and held by clips 41. A light switch 43 having a sliding contact 44 is located within one end of the battery compartment. The batteries 40 are electrically connected in a conventional manner through the switch 43 to each of the light bulbs 37.

A plastic translucent cover 45 is provided for each of the side light compartments 35. The sides of the plastic cover 25 snap into grooves 47 (FIG. 4) provided on the transverse wall of the framework 30 and the transverse partition 31 forming each of the light compartments 35.

Figure 3:
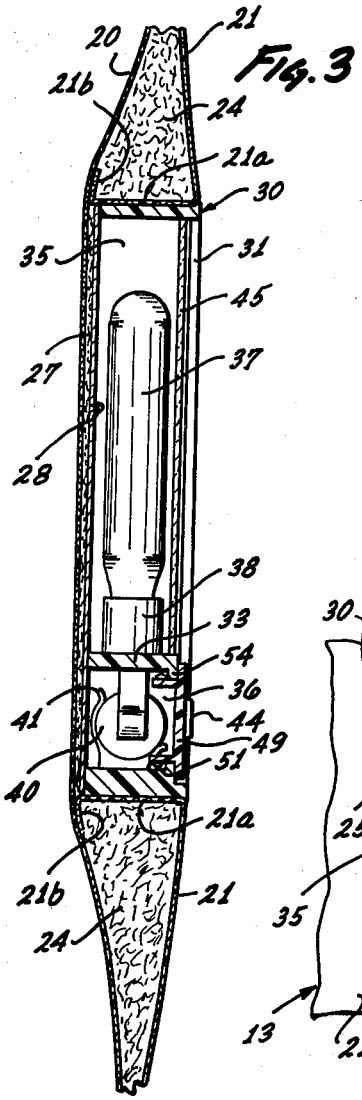
FIG. 3 is a sectional view taken along line 3—3 of FIG. 2.

A plastic cover 49 is provided for the battery compartment 36. As shown in FIG. 3, the cover 49 is formed with button projections 51 on the lower end thereof which snap beneath the side shoulders 54 of the battery compartment and serve to removably hold it in place.

A mirror is positioned against the paper sheet 28 in the portion of the opening of well 25 formed between the light compartments. The mirror 52 is retained in position by a plastic retainer 53.

It should be noted that the framework 30 inserted in the well 25 formed by the cutout of the inner sheet 21 causes the outer sheet 20 of the flap 13 to bulge outwardly to form a generally rectangularly shaped protrusion 55 which is apparent when the flap 13 is latched in its closed position against the front wall of the pocket 12. The outer surface of the protrusion 55 may be provided with a design, as shown in FIG. 1, which adds to the attractiveness of the handbag 10. The inner wall of the flap 13 is made relatively flatter so that it tends to lie against the front wall of the pocket 12 when latched by latch 19.

It should now be evident that when a woman desires to check her appearance in a place or at a time when the ambient light is not sufficient for such purpose, she can release the latch 19 of her handbag 10 and fold up the flap 13. She can then illuminate the exposed mirror 52 by snapping on the sliding contact 44 of the switch 43. In accordance with the teachings of the present invention, it should now be evident that the inserting of the mirror 52 with its side light bulbs 37 in a well 25 provided on the undersurface of the flap 13 which is an integral part of the handbag carried by a woman, enables the various forms of makeup carried in the pocket 12 of the handbag 10 to be readily available for applying to her face as needed.

From the above description it will be apparent that there is thus provided a device of the character described possessing the particular features of advantage previously enumerated as desirable but which obviously is susceptible of modification in its form, proportion, detail construction and arrangement of parts without departing from the principles involved or sacrificing any of its advantages.

While in order to comply with the statute the invention has been described in language more or less specific as to structural features, it is to be understood that the invention is not limited to the specific features shown but that the means and construction herein disclosed comprises the preferred form of several modes of putting the invention into effect and the invention is therefore claimed in any of its forms or modifications within the legitimate and valid scope of the appended claims.

What is claimed is:

1. A woman's purse comprising a pocket having a flap integrally formed with the back wall thereof and folded down to substantially cover the front wall thereof, said flap comprising an inner and outer sheet of material secured along the peripheral edge thereof, the inner sheet having a rectangular cutout with the edge portions on all four sides thereof folded inwardly and the terminating edges secured to the outer sheet whereby said edge portions form walls of a rectangular well on said flap, a padding material within the peripheral portions of the inner and outer sheets for providing a body for said flap and shaping the walls of said well, a rectangular framework disposed in said well with the sides thereof secured to the walls thereof, said framework including transverse partitions spaced inwardly from either transverse sidewall thereof to provide side light compartments each having a socket means and an electric light bulb therein, and a longitudinal partition spaced from a longitudinal side wall of the framework to provide a battery compartment having a battery and light switch therein, the spacing between the transverse partitions of said framework having a mirror retained therein, translucent covers for each of said light compartments, and a cover for said battery compartment.

2. The invention in accordance with claim 1 wherein said purse is a handbag including a strap connected to the upper corners of said pocket, and a latch for holding said flap in its closed position against the front wall of said pocket.

3. The invention in accordance with claim 1 wherein said framework is formed of plastic.

4. The invention in accordance with claim 1 wherein said framework forms a rectangular protrusion on the outer surface of said flap formed by said outer sheet of material.

* * * * *